US007600340B2

(12) United States Patent
Curry et al.

(10) Patent No.: US 7,600,340 B2
(45) Date of Patent: Oct. 13, 2009

(54) LOCKING APPARATUS FOR A FIREARM

(75) Inventors: Brett Curry, Chicopee, MA (US); Gary E. Zukowski, Indian Orchard, MA (US)

(73) Assignee: Smith & Wesson Corp., Springfield, MA (US)

( * ) Notice: Subject to any disclaimer, the term of this patent is extended or adjusted under 35 U.S.C. 154(b) by 334 days.

(21) Appl. No.: 11/316,529

(22) Filed: Dec. 22, 2005

(65) Prior Publication Data

US 2006/0191182 A1 Aug. 31, 2006

Related U.S. Application Data

(60) Provisional application No. 60/638,594, filed on Dec. 22, 2004, provisional application No. 60/639,187, filed on Dec. 22, 2004, provisional application No. 60/638,753, filed on Dec. 22, 2004, provisional application No. 60/638,593, filed on Dec. 22, 2004, provisional application No. 60/638,746, filed on Dec. 22, 2004, provisional application No. 60/638,592, filed on Dec. 22, 2004, provisional application No. 60/638,751, filed on Dec. 22, 2004, provisional application No. 60/638,752, filed on Dec. 22, 2004.

(51) Int. Cl.
*F41A 17/02* (2006.01)
*F41A 17/56* (2006.01)

(52) U.S. Cl. ..... 42/70.11; 42/70.05; 42/70.01

(58) Field of Classification Search ..... 42/70.01, 42/70.02, 70.04, 70.05, 70.06, 70.11
See application file for complete search history.

(56) References Cited

U.S. PATENT DOCUMENTS 1,719,384 A * 7/1929 Tansley ..... 89/137
3,109,345 A * 11/1963 Norman ..... 89/144
3,462,869 A * 8/1969 Wallace ..... 42/70.08
4,011,678 A 3/1977 Brodbeck et al.
4,031,648 A 6/1977 Thomas
4,522,105 A 6/1985 Atchisson
4,539,889 A 9/1985 Glock
4,825,744 A 5/1989 Glock
4,893,546 A 1/1990 Glock
4,967,724 A 11/1990 Senfter
5,012,604 A 5/1991 Rogers
5,018,292 A 5/1991 West
5,024,139 A 6/1991 Knight, Jr. et al.
5,036,612 A 8/1991 Jennings
5,050,480 A 9/1991 Knight, Jr. et al.

(Continued)

*Primary Examiner*—Troy Chambers
(74) *Attorney, Agent, or Firm*—McCormick, Paulding & Huber LLP

(57) ABSTRACT

A firearm includes a frame and a firing mechanism having a sear (e.g., configured for controlled release of a firing pin) and a trigger bar for actuating the sear. The trigger bar is disengageable from the sear. A locking mechanism is attached to the frame and can be actuated (e.g., by using a key) to selectively disengage the trigger bar from the sear. The locking mechanism may include a pin extending through the frame and axially rotatable in place. A first end of the pin is accessible from the exterior of the frame for key actuation, and a second end of the pin is positioned proximate to the trigger bar in the interior of the frame. The second end of the pin is provided with a cam surface for laterally shifting the trigger bar out of engagement from the sear when the pin is axially rotated using a key.

19 Claims, 6 Drawing Sheets

U.S. PATENT DOCUMENTS 5,050,481 A 9/1991 Knight, Jr. et al.
5,081,780 A 1/1992 Lishness et al.
5,086,578 A 2/1992 Lishness et al.
5,086,579 A 2/1992 Flatley et al.
5,088,222 A 2/1992 Larson
5,090,147 A 2/1992 Pastor
5,105,570 A 4/1992 Lishness et al.
5,115,588 A 5/1992 Bronsart et al.
5,119,634 A 6/1992 Berry et al.
5,149,898 A 9/1992 Chesnut et al.
5,157,209 A 10/1992 Dunn
5,160,796 A 11/1992 Tuma et al.
5,164,534 A 11/1992 Royster
5,166,458 A 11/1992 Yoo
5,187,312 A 2/1993 Osborne
5,195,226 A 3/1993 Bornancini
5,216,191 A 6/1993 Fox
5,216,195 A 6/1993 Tuma
5,225,612 A 7/1993 Bernkrant
5,235,770 A 8/1993 Simon et al.
5,241,769 A 9/1993 Von Muller
5,247,757 A 9/1993 Deeb
5,251,394 A 10/1993 Bornancini
5,267,407 A 12/1993 Bornancini
5,272,957 A 12/1993 Chesnut et al.
5,299,374 A 4/1994 Mathys
5,303,494 A 4/1994 Tuma et al.
5,327,810 A 7/1994 Sandusky et al.
5,349,939 A 9/1994 Perrone
5,355,768 A 10/1994 Felk
5,373,775 A 12/1994 Findlay, Sr. et al.
5,386,659 A 2/1995 Vaid et al.
5,388,362 A 2/1995 Melcher
5,400,537 A 3/1995 Meller et al.
5,412,894 A 5/1995 Moon
5,417,001 A 5/1995 Rousseau
5,426,881 A 6/1995 Ruger
5,438,784 A 8/1995 Lenkarski et al.
5,448,939 A 9/1995 Findlay, Sr. et al.
5,487,233 A 1/1996 Jewell
5,493,806 A 2/1996 Langevin et al.
5,502,914 A 4/1996 Moon
5,517,896 A 5/1996 Perrine
5,517,987 A 5/1996 Tsuchiya
5,548,914 A 8/1996 Anderson
5,570,527 A 11/1996 Felicci
5,581,927 A 12/1996 Meller
5,604,326 A 2/1997 Lescure
5,606,825 A 3/1997 Olsen
5,615,507 A 4/1997 French
5,623,114 A 4/1997 Soper
5,625,971 A 5/1997 Tuma et al.
5,634,456 A 6/1997 Perrone
5,635,664 A 6/1997 Pons et al.
5,640,794 A 6/1997 Gardner et al.
5,655,326 A 8/1997 Levavi et al.
5,669,169 A 9/1997 Schmitter et al.
5,669,252 A * 9/1997 Bentley ..... 70/14
5,680,722 A 10/1997 French et al.
5,697,178 A 12/1997 Haskell
5,701,698 A 12/1997 Wesp et al.
5,709,046 A 1/1998 Canaday
5,711,286 A 1/1998 Petrosyan et al.
5,713,150 A 2/1998 Ealovega
5,717,156 A 2/1998 Lenkarski
5,718,074 A 2/1998 Keeney
5,736,667 A 4/1998 Munostes et al.
5,758,524 A * 6/1998 Yu ..... 70/276
5,760,328 A 6/1998 Robbins
5,770,814 A 6/1998 Ealovega
5,778,585 A 7/1998 Sigg
5,797,206 A 8/1998 Vitorino
5,806,225 A 9/1998 Gardner et al.
5,815,973 A 10/1998 Hochstrate
5,826,362 A 10/1998 Lyons
5,834,678 A 11/1998 Kalb
5,852,891 A 12/1998 Onishi et al.
5,857,280 A 1/1999 Jewell
5,906,066 A 5/1999 Felk
5,913,261 A 6/1999 Guhring et al.
5,974,717 A 11/1999 Brooks
5,987,796 A 11/1999 Brooks
6,000,162 A 12/1999 Hochstrate
6,070,512 A 6/2000 Rohrbaugh
6,125,735 A 10/2000 Guhring
6,131,324 A 10/2000 Jewell
6,134,852 A 10/2000 Shipman et al.
6,164,001 A 12/2000 Lee
6,205,694 B1 3/2001 Davis, Sr.
6,240,669 B1 6/2001 Spaniel et al.
6,253,479 B1 7/2001 Fuchs et al.
6,256,918 B1 7/2001 Szabo
6,256,920 B1 7/2001 Olson
6,263,607 B1 7/2001 Fuchs et al.
6,266,909 B1 7/2001 Fuchs et al.
6,272,683 B1 8/2001 Symms et al.
6,272,783 B1 8/2001 Dumortier et al.
6,289,619 B1 9/2001 Fuchs et al.
6,293,039 B1 9/2001 Fuchs
6,341,442 B1 1/2002 Szabo et al.
6,354,032 B1 3/2002 Viani
6,367,186 B1 4/2002 Gibala
6,381,892 B1 5/2002 Szabo et al.
6,382,200 B1 5/2002 Levkov
6,405,631 B1 6/2002 Milek
6,412,206 B1 7/2002 Strayer
6,415,702 B1 7/2002 Szabo et al.
6,425,199 B1 7/2002 Vaid et al.
6,448,939 B2 9/2002 Maruta
6,513,273 B2 2/2003 da Silveira
6,519,887 B1 2/2003 Allen et al.
6,526,684 B1 3/2003 Hickerson
6,539,658 B1 4/2003 Hubert et al.
6,543,169 B2 4/2003 Bero
6,553,706 B1 4/2003 Gancarz et al.
6,557,288 B2 5/2003 Szabo
6,560,909 B2 5/2003 Cominolli
6,588,136 B2 7/2003 Baker et al.
6,601,331 B2 8/2003 Salvitti
6,615,527 B1 9/2003 Martin
6,640,478 B2 11/2003 Johansson
6,643,968 B2 11/2003 Glock
6,655,066 B2 12/2003 Fluhr
6,665,973 B1 12/2003 Peev
6,688,210 B2 2/2004 Bubits
6,705,036 B2 3/2004 Orr
6,711,824 B2 3/2004 Hruska
6,711,842 B1 3/2004 Chapman
6,718,680 B2 4/2004 Roca et al.
6,732,464 B2 5/2004 Kurvinen
6,735,897 B1 * 5/2004 Schmitter et al. ..... 42/70.01
6,769,208 B2 8/2004 Beretta
6,775,941 B1 * 8/2004 McNulty, Jr. ..... 42/70.11
6,789,342 B2 9/2004 Wonisch et al.
6,871,437 B1 * 3/2005 Bartozzi et al. ..... 42/70.11
6,889,459 B1 * 5/2005 Salvitti ..... 42/70.08
7,225,575 B2 * 6/2007 Kiesel et al. ..... 42/70.08
7,234,261 B2 * 6/2007 McGarry ..... 72/70.05
2001/0042332 A1 * 11/2001 Gering et al. ..... 42/70.08
2002/0194762 A1 * 12/2002 Cominolli ..... 42/70.06

* cited by examiner

LOCKING APPARATUS FOR A FIREARM

This application claims the benefit of the following U.S. Provisional Applications: Ser. No. 60/639,187; Ser. No. 60/638,594; Ser. No. 60/638,753; Ser. No. 60/638,593; Ser. No. 60/638,746; Ser. No. 60/638,592; Ser. No. 60/638,751; and Ser. No. 60/638,752, all filed Dec. 22, 2004, and all hereby incorporated by reference herein in their entireties.

TECHNICAL FIELD

The present invention relates generally to devices for locking firearms and, more particularly, to key locks for semiautomatic pistols or handguns.

BACKGROUND OF THE INVENTION

Various devices have been used to prevent the discharge of firearms. Such devices have included trigger locks or similar mechanisms that, when incorporated into the firearm, deter the firing of the firearm by incapacitating the trigger. Trigger locks typically consist of two mating elements that are mounted and locked together over or around the trigger guard and trigger of the firearm, thereby blocking access to and/or movement of the trigger.

Other devices used to prevent the discharge of firearms employ an integral mechanical combination lock to secure the firearm. These devices typically employ mechanical keypads with small numbered buttons or dials that are used to enter the numbered code to unlock the device and remove it from the firearm.

Although the aforesaid devices can be effective, they generally work in a manner where certain firearm components, e.g., the trigger, are blocked or restricted. Thus, if the device is bypassed and the trigger accessed, it may be possible to discharge the firearm. What is needed is a locking device that, when enabled, prevents the firing of a firearm even if the trigger is actuated.

SUMMARY OF THE INVENTION

A firearm incorporating an embodiment of the locking mechanism of the present invention includes a frame and a firing mechanism. The firing mechanism has a sear (e.g., configured for controlled release of a firing pin) and a trigger bar for actuating the sear. The trigger bar is disengageable from the sear. The locking mechanism is attached to the frame and can be actuated using a key to selectively disengage the trigger bar from the sear.

In another embodiment, the locking mechanism includes an axially rotatable pin. A first end of the pin is accessible from the exterior of the firearm for key actuation, and a second end of the pin is positioned proximate to the trigger bar in the interior of the frame. The second end of the pin is provided with a cam surface for laterally shifting the trigger bar out of engagement from the sear when the pin is axially rotated. For example, the second end of the pin may include a face surface perpendicular to the axis of the pin, a stepped land integral therewith, and an arcuate, ramp-like surface extending between the face and land. In a first axial position of the pin, the trigger bar lies against the face surface. When the pin is rotated in place, the arcuate, ramp-like portion of the pin rotates into contact with the trigger bar, gradually laterally shifting the trigger bar until it comes to rest against the land, out of engagement with the sear.

One advantage of the locking apparatus of the present invention is that a handgun incorporating such a locking apparatus blocks the operation of the trigger. The operation of the trigger is blocked because the mechanical link between the trigger assembly and the fire control mechanism (namely, the trigger bar) is disengaged.

Another advantage is that such a locking apparatus is made difficult or impossible to defeat by smashing the exposed end of the pin. In particular, because the operable portion of the locking apparatus (e.g., the cammed surface that causes the disengagement of the trigger bar from the sear) is housed within the frame of the handgun, an attempted defeat of the apparatus will likely result in damage being caused to the portion at which the key engages the pin to lock or unlock the handgun.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
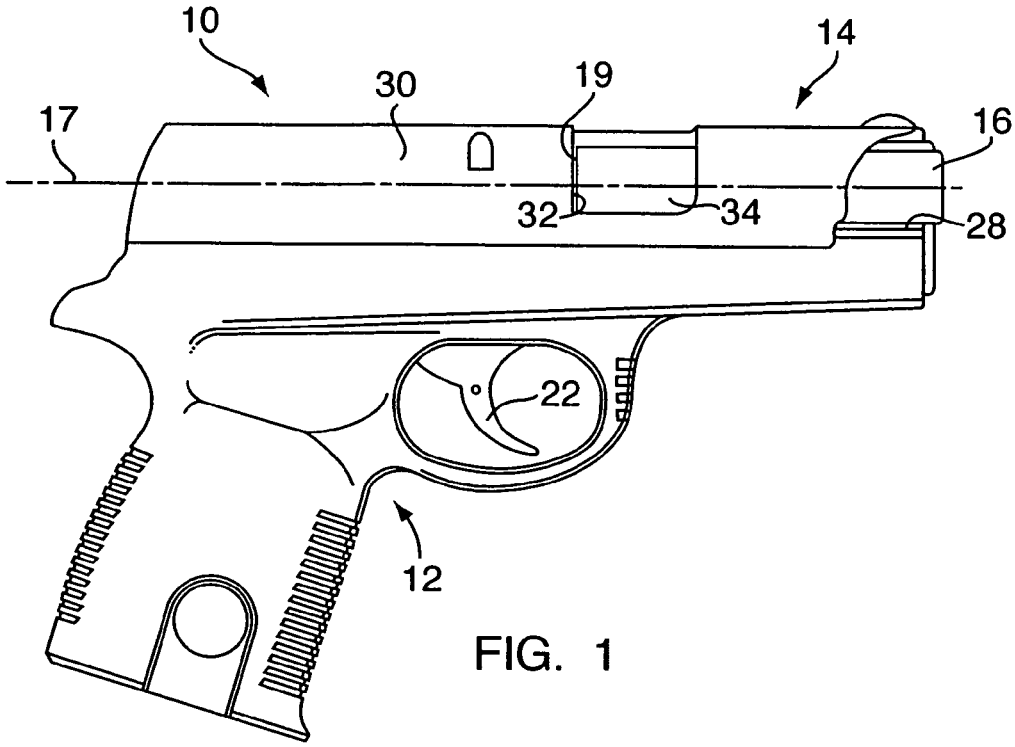
FIG. 1 is a simplified schematic side view of a semiautomatic pistol.
Figure 2:
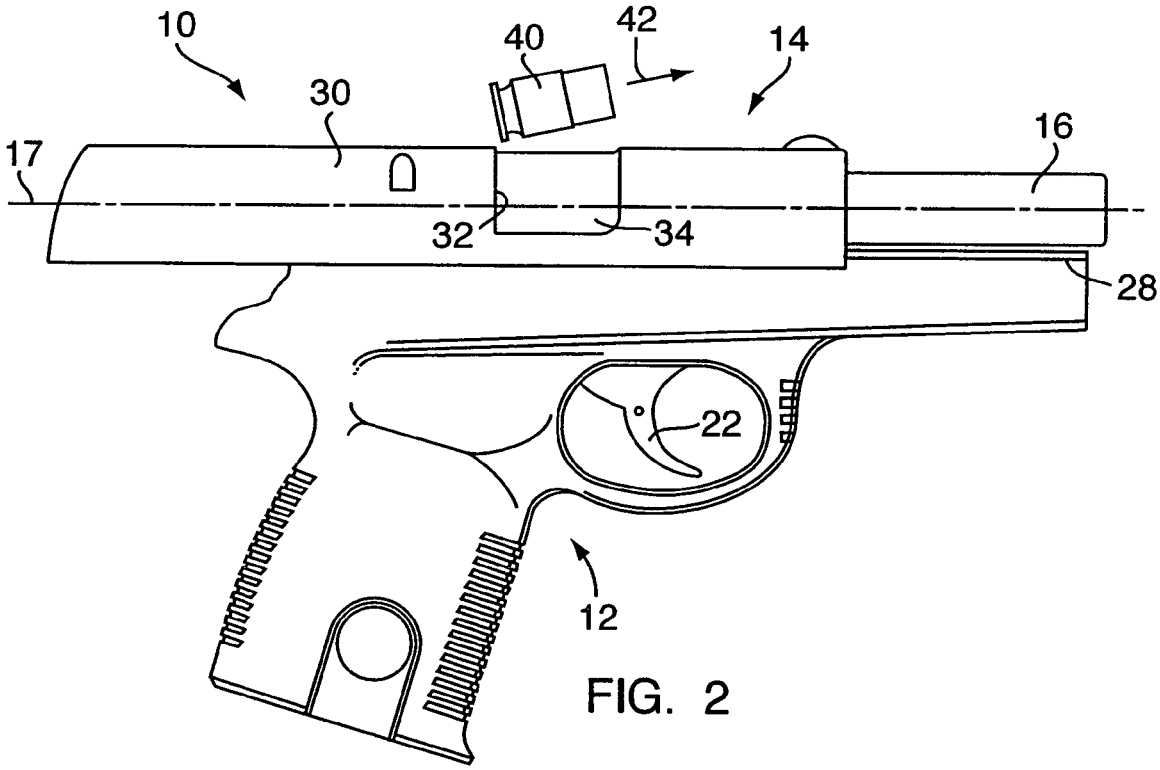
FIG. 2 is a simplified schematic side view of the pistol of FIG. 1 shown with the slide moved to a rearward position on the pistol frame.

Referring to FIGS. 1 and 2, one exemplary embodiment of a semiautomatic pistol or handgun which may incorporate the locking apparatus of the present invention is shown generally at 10 and is hereinafter referred to as "firearm 10." The firearm 10 comprises a frame 12, a slide 14, and a fire control mechanism 18 (see FIG. 2) that operates via actuation of a trigger 22. The frame 12 is fabricated of a high-impact polymer material, metal, a combination of polymer and metal, or other suitable materials. The slide 14 houses a barrel 16 in the forward end thereof. The barrel 16 is cooperatively linked with the slide 14 and, together with the slide 14, defines a longitudinal firing axis 17. A rearward end 19 of the barrel 16 is adapted for receiving an ammunition cartridge.

The slide 14 is fitted to opposingly-positioned rails 28 on the frame 12 to effect the reciprocal movement of the slide 14 along the longitudinal firing axis 17. The rails 28 extend along the underside of the slide 14 in the longitudinal direction and are cooperative with the frame 12 to allow the cycling of the slide 14 between forward (battery) and rearward (retired) positions. The slide 14, which is defined by a slide frame 30, further includes a breech face 32 and an extractor port 34. The breech face 32 is engagable with the rearward end 19 of the barrel 16 to form a firing chamber when the slide 14 is disposed forwardly on the frame 12 (see FIG. 1). An ejection mechanism provides for the ejection of a cartridge casing 40 in a direction indicated by an arrow 42 upon firing the firearm 10 or manually cycling the slide 14.

Figure 3:
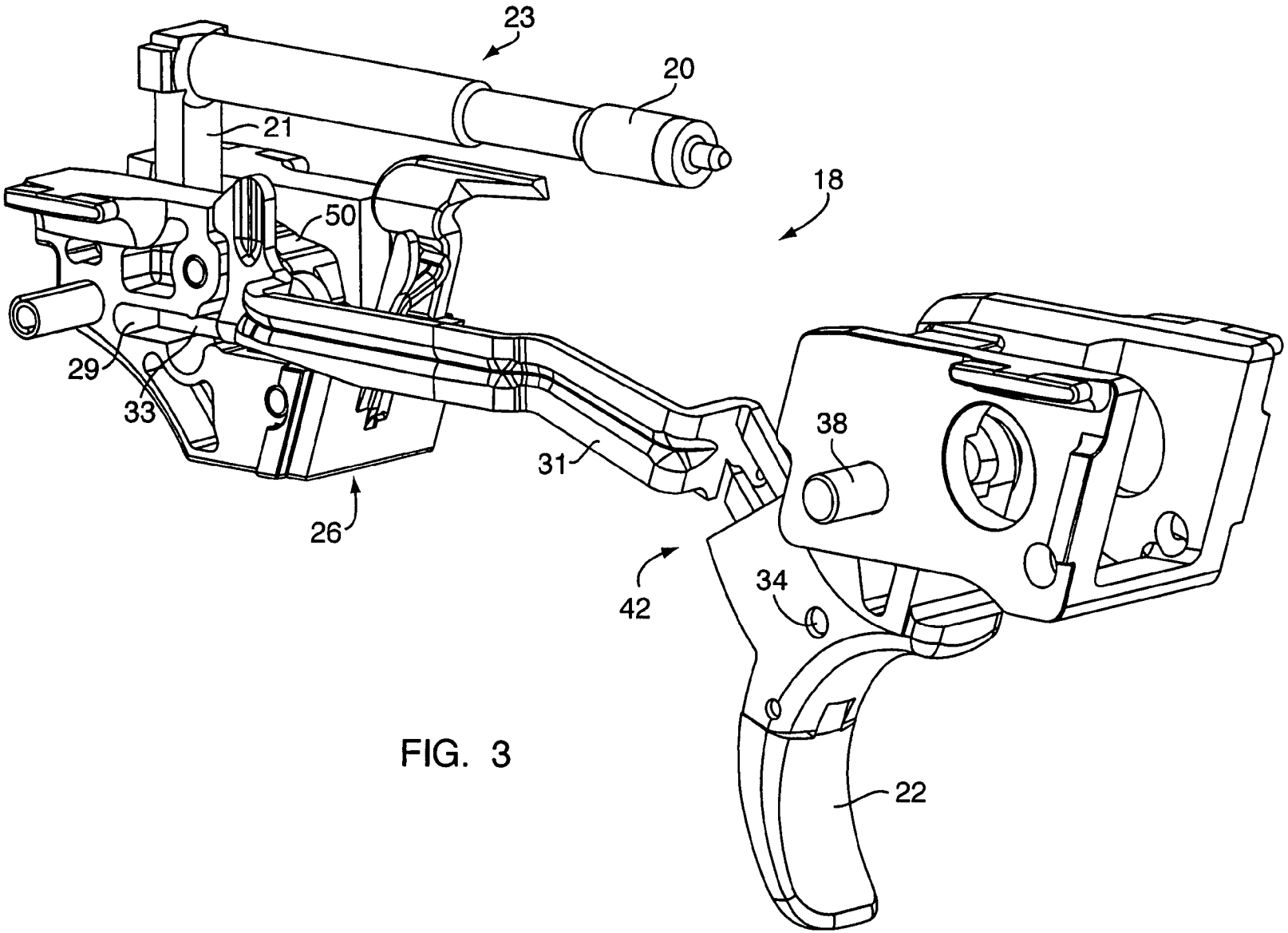
FIG. 3 is a simplified schematic perspective view of a fire control mechanism portion of the pistol of FIG. 1.

Referring now to FIG. 3, the fire control mechanism is shown at 18. The fire control mechanism 18 is of a striker-type firing pin configuration, and comprises a striker-type firing pin 23 having a firing pin portion 20 and a depending leg 21. The fire control mechanism further comprises a sear assembly 26 and a trigger assembly 42. The sear assembly 26 has a pivotally-mounted sear 50 that selectively engages the firing pin 23. The trigger assembly 42, which functions to actuate the sear 50, includes the trigger 22 and a trigger bar 31 pivotally connected to the trigger 22 via a pin 34. The trigger bar 31 connects the trigger 22 and the sear assembly 26. A trigger bar extension 33 extends from the trigger bar structure into a channel 29 of the sear assembly 26. The trigger 22 may be of unitary construction, as shown, or of a multiple-piece articulated construction. When the trigger 22 is actuated by being pressed in a rearward direction, the trigger 22 pivots about a pin 38 and transmits movement to the trigger bar 31 via the pin 34. The trigger bar 31 is thereby moved in a rearward direction substantially parallel to the longitudinal firing axis such that the trigger bar extension 33 correspondingly translates in the channel 29. The connection of the trigger bar 31 to the trigger 22 and sear assembly 26 is such that the trigger bar 31 can be laterally displaced away from the sear assembly 26 when pressure is exerted on the trigger bar 31 and/or trigger bar extension 33, e.g., in a direction that is perpendicular to the direction in which the longitudinal firing axis extends.

Figure 4:
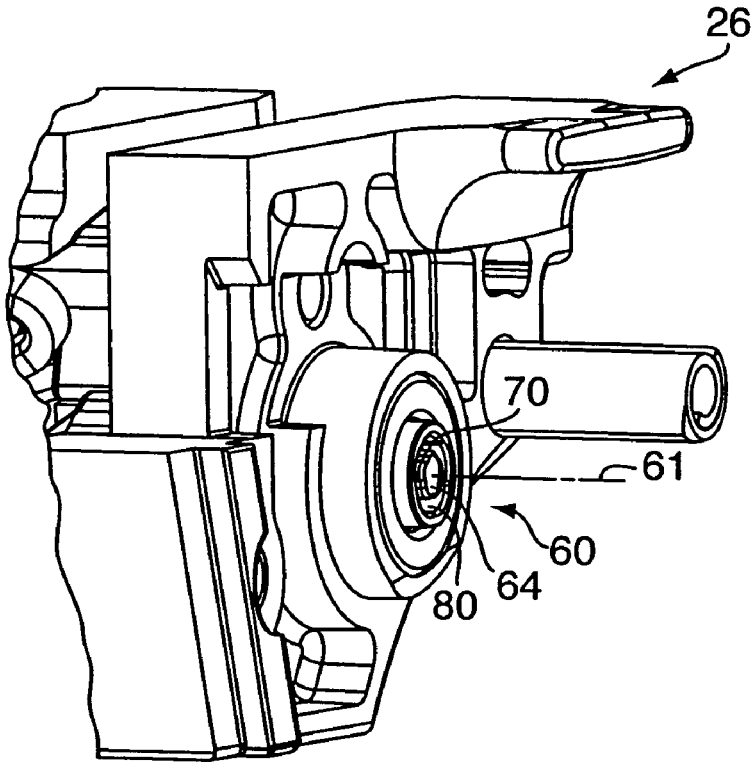
FIG. 4 is a simplified schematic perspective view of a key lock according to an embodiment of the present invention.
Figure 5:
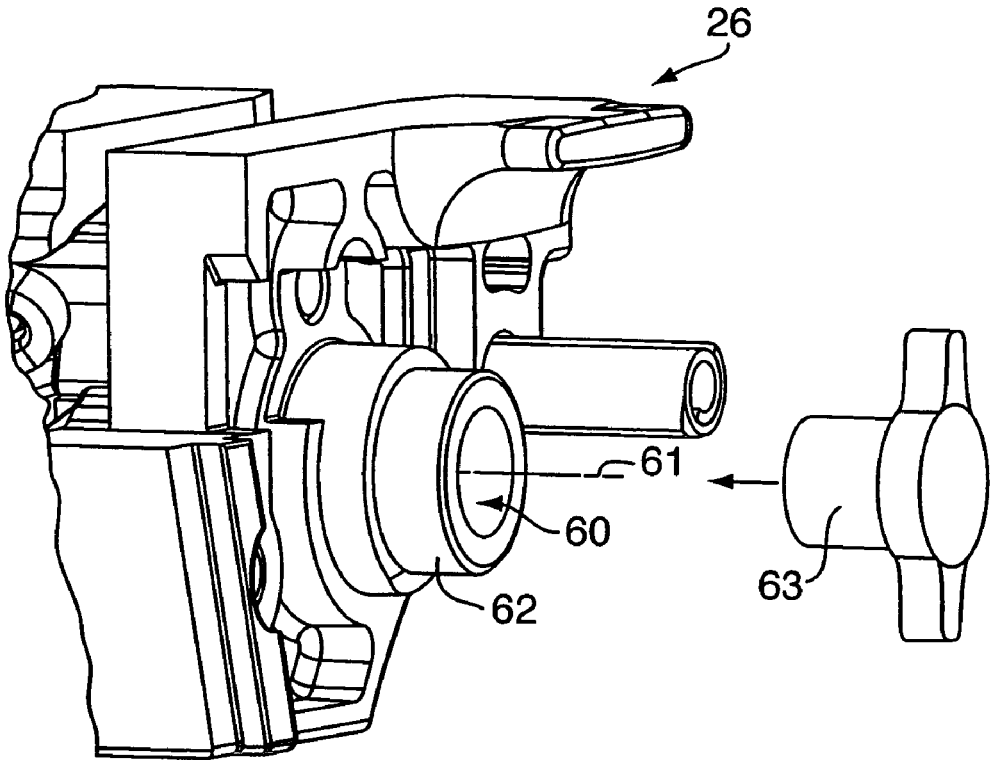
FIG. 5 is a simplified schematic perspective view of the key lock of FIG. 4 illustrating a sleeve disposed over the key lock.

Referring now to FIGS. 4 and 5, a key lock (locking mechanism means) of the present invention is shown generally at 60. The key lock 60 includes a selectively rotatable element mounted on the frame of the handgun to effect the selective engagement of the trigger bar 31 with the sear 50. A positive force is used to rotate the selectively rotatable element about an axis 61. In one embodiment, the selectively rotatable element is a pin 70. When the handgun is in an operational mode (e.g., when the key lock 60 is disengaged or in the "unlocked" position), a cooperating sloped surface 75 on the trigger bar engages the sear 50. Longitudinal movement of the trigger bar 31 in a rearward direction causes the sear 50 to rotate and eventually disengage from the depending leg 21 of the firing pin 23. This unblocks the firing pin, allowing the firing pin to translate in a forward direction under the urging of a decompressing firing pin spring, and to engage a cartridge in a firing chamber to fire the handgun. When the handgun is "locked" (e.g., when the key lock 60 is engaged), the pin 70 urges the trigger bar laterally within the frame of the handgun such that the cooperating surface 75 on the trigger bar is disengaged from the sear 50. Thus, because the mechanical link between the trigger bar and the sear is interrupted, the operation of the trigger has no effect on the movement of the sear 50.

A sleeve 62 (FIG. 5) may be mounted over a first end 64 (FIG. 4) of the pin 70 to receive a key 63, the rotation of which provides for the rotation of the pin 70. The first end 64 of the pin 70 is contoured to receive the key. For example, in the embodiment depicted, the first end 64 is contoured to have an irregular shape that corresponds to an irregularly shaped receiving surface on the key. The irregular shape of the first end 64 and the corresponding receiving surface of the key are closely machined such that the surfaces inter-engage to have little tolerance. The irregular shape is preferably configured such that a key having receiving surfaces cannot be readily fabricated by an unauthorized user of the handgun for the purpose of defeating the key lock 60.

Figure 6A:
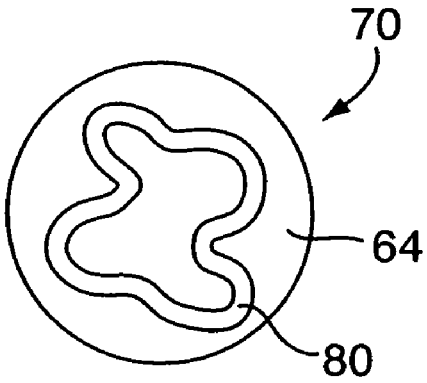
FIGS. 6A to 6E are exemplary schematic views of various configurations for an irregular shape of the key lock.
Figure 6B:
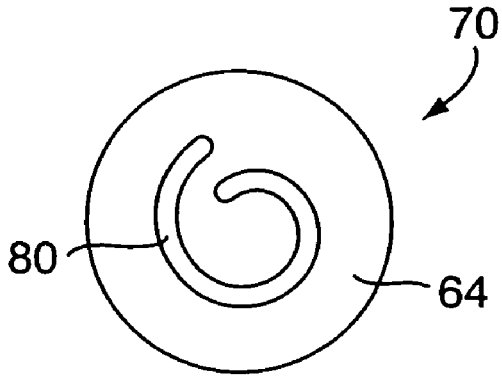
Figure 6C:
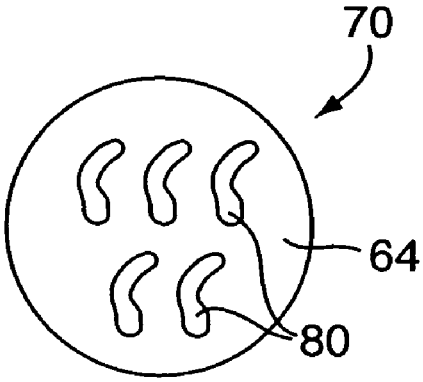
Figure 6D:
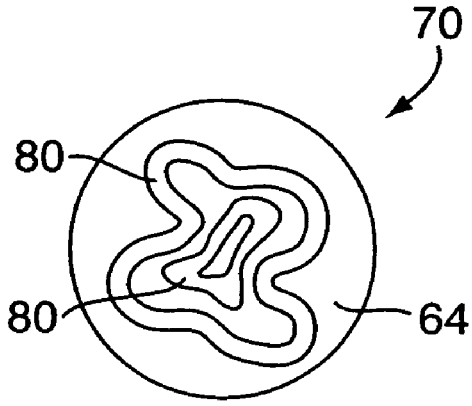
Figure 6E:
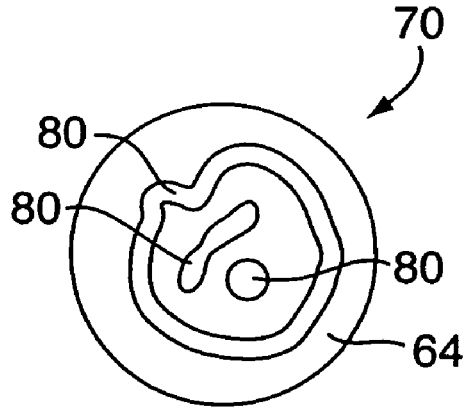

The irregular shape contoured into the first end 64 may comprise at least one groove, indentation, hole, slot, or other channel 80 that extends from an end surface of the first end 64 longitudinally into the surface. Referring now to FIGS. 6A through 6E, various configurations of the irregular shape of the key lock are shown. The channel 80 formed in the first end 64 of the pin 70 may be continuous as shown in FIG. 6A, or it may be discontinuous and include at least two terminal end points as shown in FIG. 6B. In the embodiment shown in FIG. 6C, a plurality of short channels 80 may be formed in the first end 64 to receive corresponding projections on a key. In another embodiment shown in FIG. 6D, two or more continuous channels 80 may be nested. In still another embodiment shown in FIG. 6E, combinations of continuous, discontinuous, and nested channels 80 may be formed or otherwise disposed into the end surface of the first end 64 of the pin 70, such channels 80 being dimensioned to receive the corresponding projections of a key.

Figure 7:
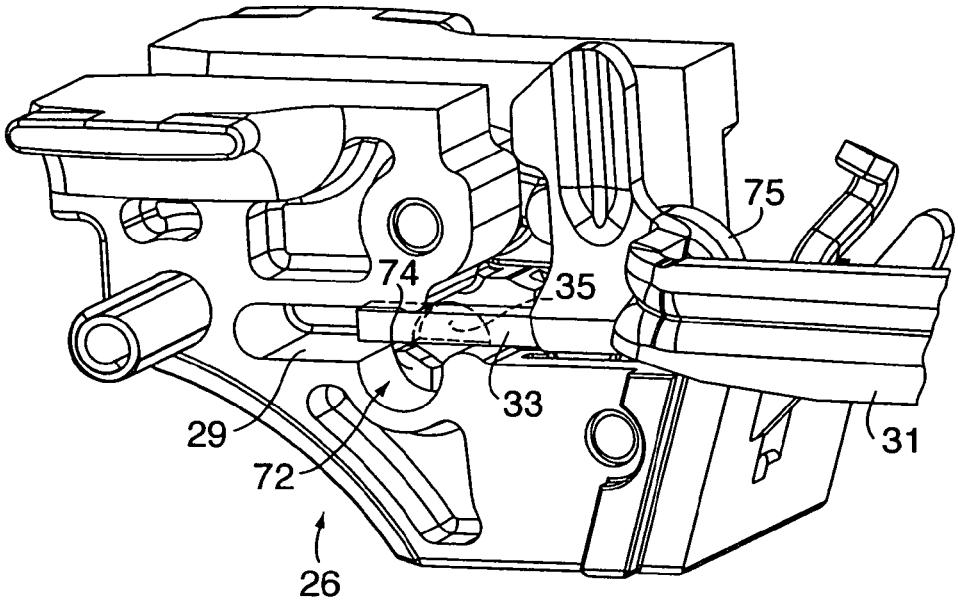
FIG. 7 is a simplified schematic perspective view of the sear assembly illustrating operable communication between the key lock and a trigger bar of the firing mechanism.

The pin 70 is positioned through the frame and the sear assembly 26 such that the pin 70 is rotatable about the axis 61. Referring now to FIG. 7, a second end 72 of the pin has a cammed surface 74 that extends axially in the direction of the axis of the pin. When the key lock 60 is disengaged or is in the "unlocked" position and the handgun is operational, the cammed surface 74 at the second end 72 is positioned under the (non-displaced) trigger bar extension 33 and a face surface 35 of the second end 72 of the pin engages a side surface of the trigger bar extension 33.

The cammed surface 74 is defined by a protrusion extending longitudinally from the face surface 35 and in a direction that corresponds with the axis (axis 61 shown in FIG. 4). Preferably, outermost surfaces of the protrusion are continuous with the outer surfaces of the body of the pin 70 such that a transition from the body of the pin 70 to the protrusion is smooth.

Figure 8:
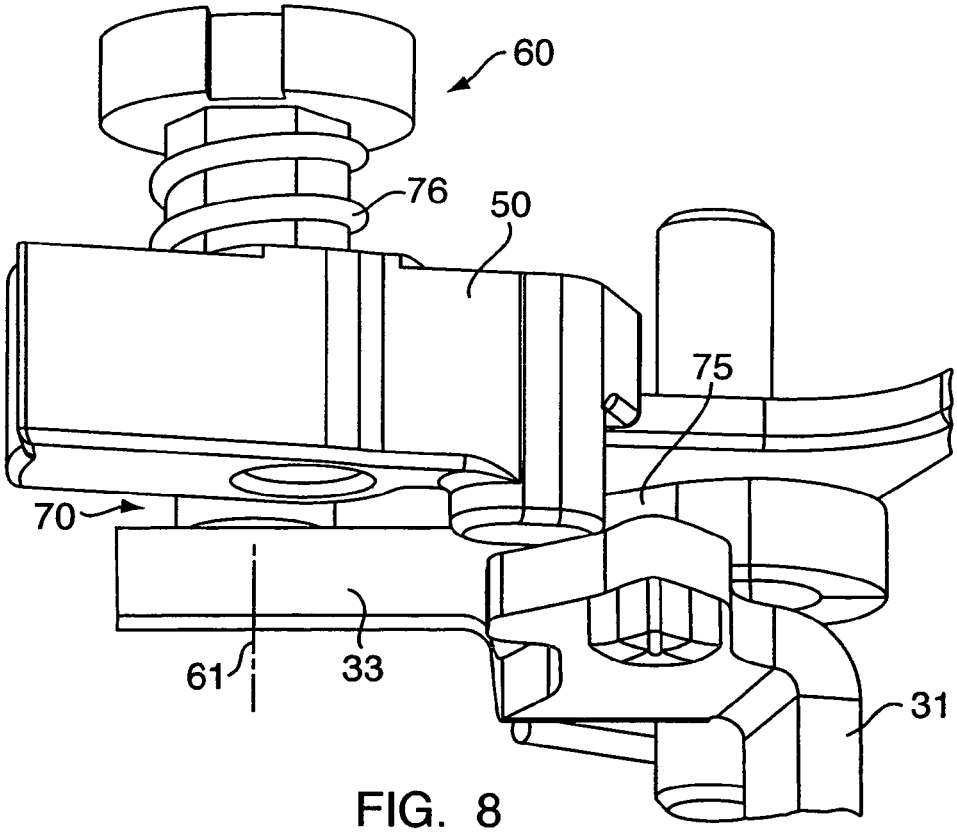
FIG. 8, FIG. 9, and FIG. 10 are simplified schematic perspective views of the key lock of the present invention as it inter-engages with the trigger bar.
Figure 9:
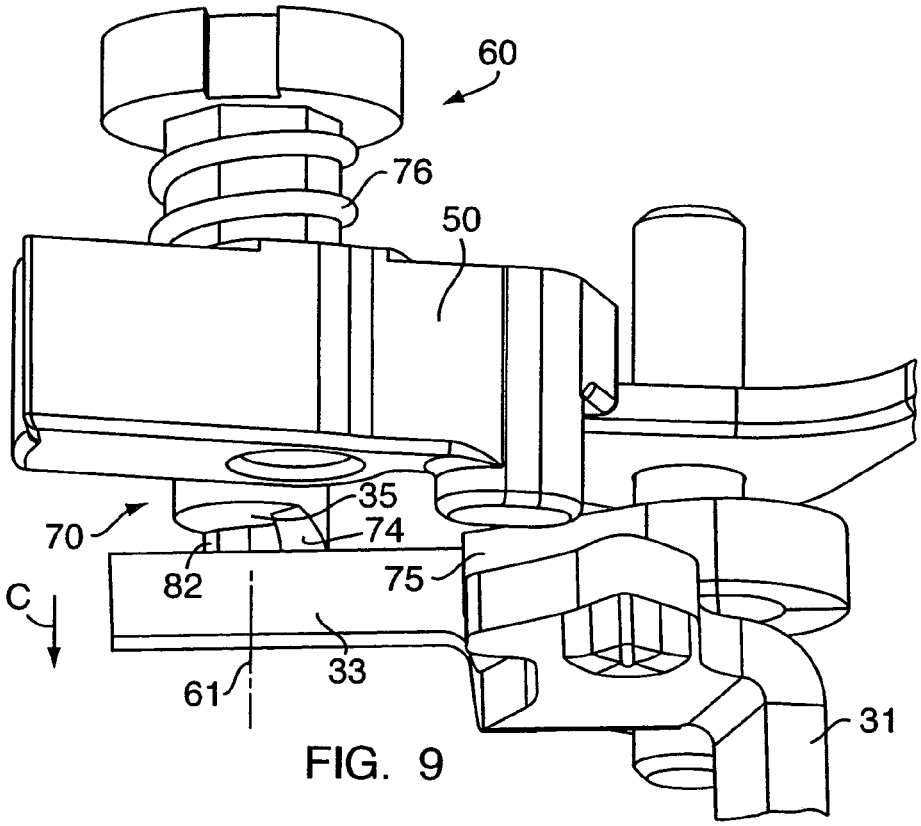
Figure 10:
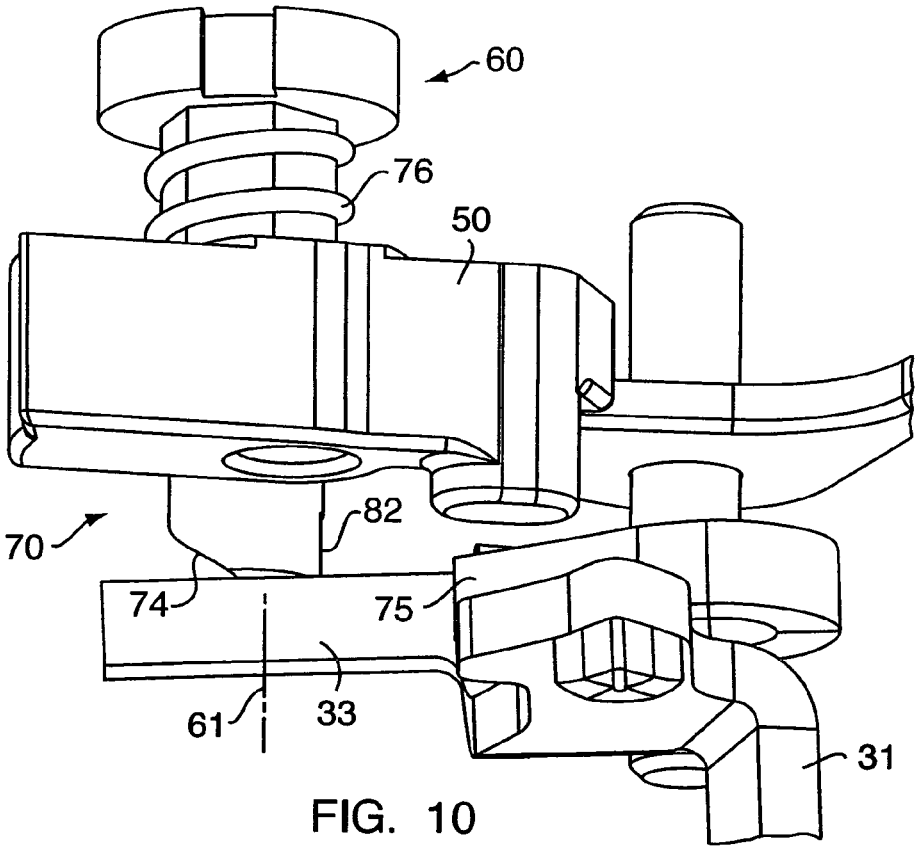

Referring now to FIGS. 8-10, the protrusion has a first end and a second end. The first end is defined by an edge 82 that extends parallel to the axis 61. The second end terminates at the face surface 35 in an edge that extends along the face surface 35 radially outward from the axis 61. The protrusion itself is chamfered such that the edge 82 and the edge at which the second end terminates are connected by the cammed surface 74, which comprises a continuous arcuate surface that provides a gradual incline from the edge 82 to the face surface 35 along which an object (namely, the trigger bar extension 33) can be cammed to provide movement in a direction parallel to the axis 61. The cammed surface 74 can also be thought of as comprising a stepped land parallel to the face surface 35 (see FIG. 7), with an arcuate ramp portion extending between the face surface 35 and land.

As stated above, the trigger bar 31 is laterally displaceable in a direction that is substantially perpendicular to the longitudinal firing axis 17, as indicated by arrow C in FIG. 9. As the key lock 60 is operated, the pin 70 axially rotates and the edge 82 is urged against the undersurface of the trigger bar extension 33. As the edge 82 is urged against the trigger bar extension 33, the cammed surface 74 displaces the trigger bar extension 33 (and the trigger bar 31) laterally within the channel 29 and pushes the trigger bar extension 33 out of registration with the cooperating surface on the sear 50. More specifically, when the key lock 60 is operated, the pin 70, upon overcoming the bias of an optional spring component 76, axially rotates. As the pin 70 axially rotates, the trigger bar extension 33 is cammed by the curved surface 74, which thereby forces the trigger bar 31 in the direction indicated by arrow C (FIG. 9). When the trigger bar extension 33 reaches the end of the pin 70 (FIG. 10), the trigger bar 31 is fully displaced and the trigger bar extension 33 has been pushed out of registration with the sear 50, thereby effecting a "locked" or disabled position. Once locked or disabled, the sear 50 is prevented from rotating via movement of the trigger (and the associated movement of the trigger bar) to operate the handgun.

It is only when the key lock 60 is rotated by the user to overcome the pressure of the spring 76 that the trigger bar extension 33 is allowed to return into engagement with the cooperative surface on the sear 50, thereby rendering the handgun operational.

In one embodiment of the present invention, as described above, a semiautomatic handgun comprises a frame, a reciprocating slide mounted on the frame, and a barrel mounted inside the slide. The slide comprises an elongated structure having a forward end for housing the barrel and a rearward end that houses a firing pin mechanism that cooperates with a trigger assembly and a fire control mechanism mounted in the frame. The frame includes a key lock mounted thereon. The key lock includes a pin that is mounted transversely to a longitudinal firing axis of the handgun. The pin is selectively rotatable about an axis thereof using a key. Rotation of the pin using the key causes a surface on the pin to urge a trigger bar of the trigger assembly out of contact with a sear of the fire control mechanism, thereby preventing the firing of the handgun by the actuation of the trigger.

In another embodiment of the present invention, as described above, a key lock for a handgun includes a pin mounted in the frame of the handgun transverse to a longitudinal firing axis of the handgun. The pin has a first end and a second end. The first end has a surface at which a key having a corresponding mating surface can be presented to rotate the pin in an axial direction. The second end has a cammed surface that engages a surface of a trigger bar of the handgun. The cammed surface is configured such that upon rotation of the pin in the axial direction using the key, the trigger bar is urged out of registration with a sear of a fire control mechanism to prevent firing of the handgun.

As should be appreciated, the locking mechanism could be oriented in other manners than as shown in the figures, e.g., coincident to a plane defined by the firearm frame as opposed to lying perpendicular thereto (in other words, accessible from the top or bottom of the handgun), while still effectuating a camming action upon the trigger bar.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A firearm comprising:

a frame;

a firing mechanism disposed in the frame and having a sear and a trigger bar for actuating the sear, said trigger bar having a pivot point and being laterally deflectable for disengagement from the sear; and a locking mechanism cooperative with the trigger bar and configured for actuation from an exterior of the frame for selectively disengaging the trigger bar from the sear;

wherein said locking mechanism includes an axially rotatable pin portion having a cammed surface at a distal end thereof; and wherein rotation of the pin portion towards a locked position brings the cammed surface into abutment with the trigger bar, further rotation of the pin causing the cammed surface to exert a lateral force on the trigger bar to laterally deflect the trigger bar out of engagement with the sear, without rotation of the trigger bar about its pivot point.

2. The firearm of claim 1 wherein the pin is key actuated.

3. The firearm of claim 2 wherein a first end of the pin accessible from the exterior of the frame is contoured to correspond in shape to a receiving surface of a key portion of the locking mechanism.

4. The firearm of claim 3 wherein the first end of the pin and the key are complementary irregularly shaped.

5. The firearm of claim 3 wherein the locking mechanism further comprises a sleeve attached to the frame for limiting access to the first end of the pin.

6. The firearm of claim 3 wherein the first end of the pin is provided with at least one channel configured to accommodate at least one projection portion of the key.

7. The firearm of claim 1 wherein the pin is rotatable between an unlocked position where the trigger bar engages the sear and a locked position where the pin disengages the trigger bar from the sear.

8. The firearm of claim 7 wherein:

an end of the pin proximate the trigger bar is provided with a cam surface for laterally shifting the trigger bar out of engagement with the sear when the pin is rotated from the unlocked position to the locked position.

9. The firearm of claim 8 wherein the pin is key actuated.

10. The firearm of claim 9 wherein an end of the pin accessible from the exterior of the frame is contoured to correspond in shape to a receiving surface of a key portion of the locking mechanism.

11. The firearm of claim 10 wherein the end of the pin accessible from the exterior of the frame and the key are complementary irregularly shaped.

12. A locking mechanism for a firearm firing mechanism, said locking mechanism comprising:

a key actuated pin configured for laterally deflecting a trigger bar portion of the firing mechanism to selectively disengage the trigger bar portion of the firing mechanism from a sear portion of the firing mechanism;

wherein rotation of the key actuated pin from an unlocked position of the pin to a locked position of the pin brings a distal end of the pin into abutment with the trigger bar, causing the pin to exert a lateral force on the trigger bar to laterally deflect the trigger bar out of engagement with the sear, without rotation of the trigger bar about its pivot point.

13. The locking mechanism of claim 12 wherein a first end of the pin is provided with a cam surface for laterally shifting the trigger bar out of engagement with the sear when the pin is rotated from the unlocked position to the locked position.

14. The locking mechanism of claim 13 further comprising:

a key having a receiving surface, wherein a second end of the pin is contoured to correspond in shape to the receiving surface.

15. The firearm of claim 13 wherein the cam surface comprises a face surface perpendicular to an axis of the pin, a stepped land attached to the face surface, and a ramp surface extending between the face surface and stepped land, said ramp surface being configured to laterally shift the trigger bar from a position against the face surface to a position against the stepped land and out of engagement with the sear when the pin is rotated from the unlocked position to the first position.

16. A firearm comprising:

a frame;

a firing mechanism sear disposed in the frame;

a trigger bar disposed in the frame, said trigger bar having a pivot point and being laterally moveable between a first position where the trigger bar engages the sear and a second position where the trigger bar lies disengaged from the sear; and a locking mechanism attached to the frame, said locking mechanism comprising an axially rotatable pin having first and second ends, said first end being accessible from an exterior of the frame and complementary in shape to a key portion of the locking mechanism, said key portion being configured for axially rotating the pin, and said second end having a cam surface engaging the trigger bar and configured to laterally move the trigger bar from the first position to the second position upon axial rotation of the pin;

wherein rotation of the pin from an unlocked position to a locked position brings the cam surface into abutment with the trigger bar, further rotation of the pin causing the cam surface to exert a lateral force on the trigger bar to laterally deflect the trigger bar out of engagement with the sear, without rotation of the trigger bar about its pivot point.

17. The firearm of claim 16 wherein the cam surface comprises a face surface perpendicular to an axis of the pin, a stepped land attached to the face surface, and a ramp surface extending between the face surface and stepped land, wherein in a first axial position of the pin the trigger bar lies against the face surface, and in a second axial position of the pin the trigger bar lies against the stepped land and laterally shifted out of engagement from the sear.

18. The firearm of claim 17 wherein the locking mechanism further comprises a sleeve attached to the frame for limiting access to the first end of the pin.

19. A firearm comprising:

a frame;

a firing mechanism disposed in the frame and having a sear and a trigger bar for actuating the sear, said trigger bar having a pivot point and being laterally deflectable for disengagement from the sear; and locking mechanism means attached to the frame for selectively disengaging the trigger bar from the sear;

wherein said locking mechanism means includes an axially rotatable pin portion having a cam surface at a distal end thereof; and wherein rotation of the pin towards from an unlocked position to a locked position brings the cam surface into abutment with the trigger bar, further rotation of the pin causing the cam surface to exert a lateral force on the trigger bar to laterally deflect the trigger bar out of engagement with the sear, without rotation of the trigger bar about its pivot point.

* * * * *